US011541390B2

(12) United States Patent
Jones

(10) Patent No.: US 11,541,390 B2
(45) Date of Patent: Jan. 3, 2023

(54) SAMPLE LOADING

(71) Applicant: IMEC VZW, Leuven (BE)

(72) Inventor: Benjamin Jones, Kessel-Lo (BE)

(73) Assignee: IMEC VZW, Leuven (BE)

( * ) Notice: Subject to any disclaimer, the term of this patent is extended or adjusted under 35 U.S.C. 154(b) by 1042 days.

(21) Appl. No.: 16/233,584

(22) Filed: Dec. 27, 2018

(65) Prior Publication Data

US 2019/0201895 A1 Jul. 4, 2019

(30) Foreign Application Priority Data

Dec. 28, 2017 (EP) ..... 17210770
Feb. 21, 2018 (EP) ..... 18157803

(51) Int. Cl.
*B01L 3/00* (2006.01)

(52) U.S. Cl.
CPC ... *B01L 3/502738* (2013.01); *B01L 3/502746* (2013.01); *B01L 2200/0605* (2013.01); *B01L 2300/0627* (2013.01); *B01L 2300/0867* (2013.01); *B01L 2300/0896* (2013.01); *B01L 2400/0406* (2013.01); *B01L 2400/0605* (2013.01); *B01L 2400/0688* (2013.01); *B01L 2400/086* (2013.01)

(58) Field of Classification Search
CPC ..... B01L 3/502738; B01L 3/502715; B01L 3/502746; B01L 2200/0605; B01L 2200/0621; B01L 2300/0867; B01L 2400/0406; B01L 2400/0487; B01L 2400/0688; B01L 2300/0816; B01F 33/30; B01F 25/431; B01F 25/43172; B01F 25/431971; B01F 25/4331
See application file for complete search history.

(56) References Cited

U.S. PATENT DOCUMENTS

2002/0166582 A1 11/2002 O'Connor et al.
2003/0005967 A1 1/2003 Karp
(Continued)

OTHER PUBLICATIONS

Examination Report for EP 18 157 803.0 dated Jun. 1, 2018, pp. 1-3.
(Continued)

*Primary Examiner* — Samuel P Siefke
(74) *Attorney, Agent, or Firm* — McDonnell Boehnen Hulbert & Berghoff LLP

(57) ABSTRACT

Described herein are sample loading systems for loading a sample into a processing and/or analysis system comprising: a sample reservoir for receiving a sample and a metering volume reservoir, the sample reservoir and a first side of the metering volume reservoir being interconnected through a first channel with a first flow resistance to allow filling of the metering volume reservoir with sample; a further reservoir for receiving a second fluid interconnected with the metering volume reservoir at the first side via a second channel having a smaller second flow resistance; a first valve for blocking flow of sample from the metering volume reservoir into the second channel; a second valve connected to a second side of the metering volume reservoir for controlling the blocking and flowing of sample; and a first timing circuitry for timing the opening of the second valve as a function of filling of the further reservoir.

11 Claims, 3 Drawing Sheets

(56) References Cited

U.S. PATENT DOCUMENTS

| | | | | |
|---|---|---|---|---|
| 2004/0091399 | A1 | 5/2004 | Chung et al. | |
| 2004/0209381 | A1* | 10/2004 | Peters | B01L 3/502784 436/180 |
| 2005/0249641 | A1* | 11/2005 | Blankenstein | F16K 99/0057 422/400 |
| 2005/0272144 | A1 | 12/2005 | Sando et al. | |
| 2012/0196280 | A1* | 8/2012 | Karlsen | B01L 3/502738 435/6.1 |

OTHER PUBLICATIONS

European Search Report for EP 18 15 7803 dated May 24, 2018, pp. 1-2.

Stone, Howard A. "Tuned-in flow control" Nature Physics (2009) vol. 5, pp. 178-179.

Jones, Benjamin et al. "A Capillary Pump With a Controllable Filling Pattern for Lab-On-A-Chip Applications" Microfluidics (2014), pp. 1-6.

* cited by examiner

SAMPLE LOADING

CROSS-REFERENCE TO RELATED APPLICATIONS

The present application is a non-provisional patent application claiming priority to European Application No. EP 17210770.8, filed Dec. 28, 2017, and to European Application No. EP 18157803.0, filed Feb. 21, 2018, the contents of each of which are hereby incorporated by reference.

FIELD OF THE DISCLOSURE

The invention relates to the field of micro- or nanofluidics. More particularly, the present invention relates to a sample loading system and method for metering a predetermined amount of sample.

BACKGROUND

Metering or precisely measuring of the volume of a fluid sample is needed in many applications. One such application is in blood cell differentiation or counting, where the volume of the blood sample processed must be accurately known. In a system where a relatively large amount of blood (>10 μL) is added to a sample reservoir, it may not be desirable to process the entire sample of blood since only a minute quantity (<2 μL) is needed to get accurate statistics on the blood cell make-up. Therefore, a microfluidic system needs to measure off a known quantity of blood from the sample reservoir for processing. In a capillary-driven microfluidic system, metering is challenging because most existing capillary-based valving technologies do not allow for shutting or closing off a fluid stream once it has started. In such a system, it is not possible to extract a metered volume of fluid from the sample reservoir by shutting off the flow to prevent too much sample from flowing into the system.

Conventional solutions make use of active phase change valves or use electrowetting devices or splitting off a droplet of fluid from a reservoir.

SUMMARY

Provided herein are sample loading systems and methods. More specifically, the disclosure provides sample loading systems and methods that allow loading of a metered amount of sample.

In some embodiments of the methods and devices disclosed herein, the metering of the sample and the timing for delivering the sample are automatic and/or automatically controlled by the addition of a second fluid in a further reservoir.

In one aspect, the disclosure provides sample loading systems for loading a sample into a processing and/or analysis system, the sample loading systems comprising:

a sample reservoir for receiving a sample and a metering volume reservoir, the sample reservoir and a first side of the metering volume reservoir being interconnected through a first channel with a first flow resistance so as to allow filling of the metering volume reservoir with a metered amount of sample, a further reservoir for receiving a second fluid, the further reservoir being interconnected with the metering volume reservoir at the first side via a second channel having a second flow resistance being smaller than the first flow resistance, a first valve for blocking flow of the sample from the metering volume reservoir into the second channel, a second valve connected to a second side of the metering volume reservoir for controlling the blocking and flowing of sample from the metering volume reservoir through a third channel, and a first timing circuitry for controlling the second valve as function of the filling of the further reservoir, wherein the first timing circuitry allows opening of the second valve and allows sample to flow from the metering volume reservoir through the third channel to a processing and/or analysis system.

In some embodiments, the timing circuitry is an electronic-based circuitry. In some embodiments, the timing circuitry is based on microfluidic time delay channels.

It is an advantage of embodiments of the present invention that no active pump is required. Since no active elements such as, for example, pumps are strictly required, the disclosure provides systems that are more reliable than systems with active elements, since the risk of malfunctioning of active elements can be avoided.

In some embodiments of the disclosed methods and devices, the timing between filling the further reservoir and a further action can be controlled.

In some embodiments, the ratio of the first flow resistance and the second flow resistance is at least 5 to 1, or at least 10 to 1. In some embodiments, the first flow resistance and the second flow resistance are selected such that the amount of sample entering the metered volume after initial filing is limited.

It is an advantage of some embodiments of the present invention that accurate metering is provided and that little excess sample is introduced into the metered volume.

It is an advantage of some embodiments of the present invention that a known quantity of sample is measured off.

A third valve may be present between the further reservoir and at least part of the second channel, the third valve being controlled by second timing circuitry for introducing a predetermined time delay between the filling of the further reservoir and the opening of the third valve to allow filling of the metering volume completely with sample.

In some embodiments of the disclosed methods and devices, capillary driven systems are provided using only capillary triggered valves to allow metering of a known volume of sample fluid. In some embodiments, the metering system is completely passive. In other words, in some embodiments, accurate volumetric metering can be obtained in a completely passive manner, using only capillary forces for metering and dispensing the sample into a detection chamber.

It is an advantage of some embodiments of the present invention that only capillary triggering is required and that no active control is required, as, for example, is needed when electrowetting is used.

In some embodiments, the second valve is a capillary valve and the first timing circuitry comprises a microfluidic connection between the further reservoir and the second capillary valve, which comprises a first timing channel having a length adapted for introducing a predetermined time delay between the filling of the further reservoir and the opening of the second capillary valve.

It is an advantage of some embodiments of the present invention that no active valve is required for shutting off the flow once the metered volume is filled.

In some embodiments, the third valve is a capillary valve and the second timing circuitry comprises a microfluidic connection between the further reservoir and the third valve, which comprises a second timing channel having a length for introducing a predetermined time delay between the filling of the further reservoir and the opening of the third valve, and which allows the metering volume to be completely filled with sample.

It is an advantage of some embodiments of the present invention that, although the system is based on capillary-based valving technology, the sample fluid stream can be closed off at some time after it has started, such as once the metered volume is reached.

In some embodiments, one or more of the capillary valves are silicon processed two step etch valves.

In some embodiments, the first and/or the second timing circuitry is an electronic timing circuitry for electronically controlling the second valve or the third valve, respectively.

In some embodiments, the further reservoir further comprises an interconnection to the third channel towards a processing and/or analysis system, wherein the interconnection allows mixing of the sample with a buffer fluid added to the further reservoir.

In some embodiments, the sample loading system is a microfluidic or nanofluidic system.

In some embodiments, the microfluidic or nanofluidic system is an open channel system or a closed channel system, the upper side of the closed channel system being closed with a hydrophobic cover plate.

In another aspect, the disclosure provides microfluidic sample processing and/or analysis devices comprising a sample loading system as described above.

In some embodiments, the device is a diagnostic device.

In another aspect, the disclosure provides methods for loading a sample into a microfluidic system, the methods comprising:

introducing a sample in a sample reservoir thereby allowing the sample fluid to fill a metering volume reservoir through a first channel having a first flow resistance and stopping the sample flow with a first and second valve once the metering volume reservoir is filled, introducing a second fluid into a further reservoir thereby opening a second channel having a second flow resistance being smaller than the first flow resistance, the second channel disposed between the further reservoir and the metering volume reservoir for allowing the sample and the second fluid to come into contact, the introduction of the second fluid into the further reservoir further resulting in opening the second valve based on a timing circuitry, wherein opening of the second valve allows the sample to further flow to a further processing and/or analysis system.

In some embodiments, the method further comprises timing the opening of the second valve, wherein the second valve is a capillary valve allowing the sample to further flow to a further processing and/or analysis system, and wherein opening of the second valve is timed by allowing a flow from the further reservoir to the second valve via a channel with a predetermined length, so as to introduce a predetermined time delay between the filling of the further reservoir and the opening of the valve, or wherein opening of the second valve is electronically timed as a function of the filling of the further reservoir.

In some embodiments, the method further comprises mixing a second fluid with the sample.

In another aspect, the disclosure provides use of a system as described above for blood cell differentiation or blood counting.

It is an advantage of some embodiments of the present invention that an accurate volume of the sample under study is known thus enabling an exact cell density to be obtained using a blood cell counter. For example, in some embodiments, amounts of approximately 20 nanoliters for red blood cell counting or amounts of 2 microliters for white blood cell counting can be metered. It will be understood that different amounts of red blood cells and/or white blood cells are possible and contemplated herein.

In another aspect, the disclosure provides use of a system as described above for identifying an object in a sample. In some embodiments, the system assists in identifying an object in a sample whereby the object comprises or consists of a dye, a particle, or molecules.

Particular and preferred aspects of the invention are set out in the accompanying independent and dependent claims. Features from the dependent claims may be combined with features of the independent claims and with features of other dependent claims as appropriate and not merely as explicitly set out in the claims.

These and other aspects of the invention will be apparent from and elucidated with reference to the embodiment(s) described hereinafter.

BRIEF DESCRIPTION OF THE FIGURES

The above, as well as additional, features will be better understood through the following illustrative and non-limiting detailed description of example embodiments, with reference to the appended drawings.

Figure 1:
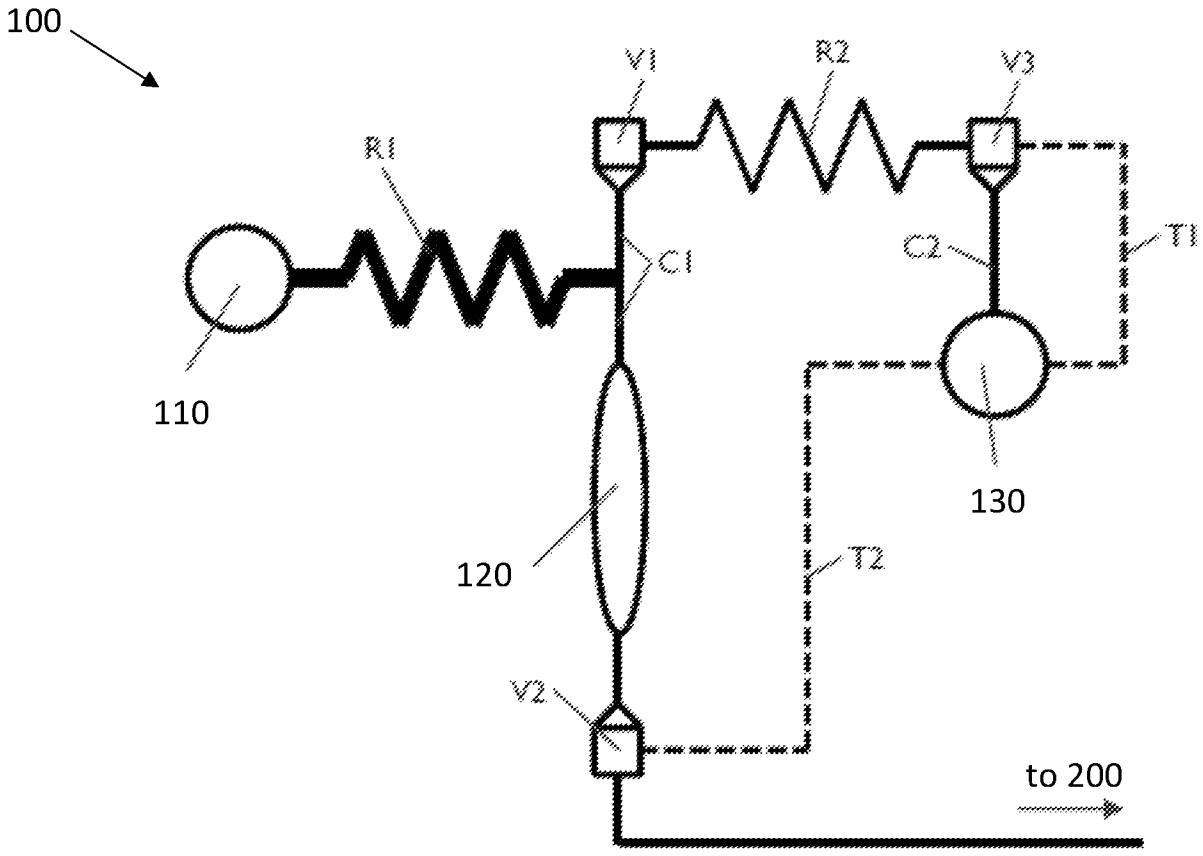
FIG. 1 shows a first exemplary sample loading system according to an example embodiment of the present invention.

The drawings are only schematic and are non-limiting. In the drawings, the size of some of the elements may be exaggerated and not drawn on scale for illustrative purposes.

Any reference signs in the claims shall not be construed as limiting the scope.

In the different drawings, the same reference signs refer to the same or analogous elements.

All the figures are schematic, not necessarily to scale, and generally only show parts which are necessary to elucidate example embodiments, wherein other parts may be omitted or merely suggested.

DETAILED DESCRIPTION

Example embodiments will now be described more fully hereinafter with reference to the accompanying drawings. That which is encompassed by the claims may, however, be embodied in many different forms and should not be construed as limited to the embodiments set forth herein; rather, these embodiments are provided by way of example. Furthermore, like numbers refer to the same or similar elements or components throughout.

In the drawings, the size of some of the elements may be exaggerated and not drawn on scale for illustrative purposes. The dimensions and the relative dimensions do not correspond to actual reductions to practice of the invention.

The terms first, second, and the like in the description and in the claims are used for distinguishing between similar elements and not necessarily for describing a sequence, either temporally, spatially, in ranking, or in any other manner. It is to be understood that the terms so used are interchangeable under appropriate circumstances and that the embodiments of the invention described herein are capable of operation in other sequences than described or illustrated herein.

Moreover, the terms top, under, and the like in the description and the claims are used for descriptive purposes and not necessarily for describing relative positions. It is to be understood that the terms so used are interchangeable under appropriate circumstances and that the embodiments of the invention described herein are capable of operation in other orientations than described or illustrated herein.

It is to be noticed that the term "comprising," used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, relevant components of the device are A and B.

Reference throughout this specification to "one embodiment" or "an embodiment" means that a particular feature, structure or characteristic described in connection with the embodiment is included in at least one embodiment of the present invention. Thus, appearances of the phrases "in some embodiments," "in one embodiment," or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly, it should be appreciated that in the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Where in embodiments of the present invention reference is made to the term "microfluidic," reference is made to fluidic structures or devices wherein there is at least one channel having at least one dimension being within the interval 1000 μm to 1 μm or smaller, or within the interval 50 μm to 1 μm or smaller. Where reference is made to the term "nanofluidic," reference is made to fluidic structures or devices wherein there is at least one channel having at least one dimension smaller than 1000 nm.

Where in embodiments of the present invention reference is made to a "sample" or "sample fluid," reference is made to the fluid of interest that needs to be characterized or in which objects are to be identified. The sample fluid may in some embodiments be a bodily fluid that can be isolated from the body of an individual. Such a bodily fluid may refer to, but is not limited to, blood, plasma, serum, bile, saliva, urine, etc. "Sample fluid" may also refer to any fluid suitable for transporting objects or components in a fluidic or microfluidic system.

Where in embodiments of the present invention reference is made to a "buffer" or "buffer fluid" this may refer to a fluid that does not react with or elute a surface coating created by the coating fluid or react with or prevent the analyte from binding with the surface coating. Although reference is made to "a" buffer or buffer fluid, more than one fluid having similar properties may be used.

In a first aspect, the present invention relates to a sample loading system for loading a sample into a processing and/or analysis system. The sample loading system may be connected to a processing and/or analysis system or may be part thereof. It may be especially suitable for use with a system for identifying an object in a fluid, although embodiments are not limited thereto and any device that may benefit from using a metered volume for processing or analysis can make use of the sample loading system of the disclosure. According to some embodiments of the present invention, the sample loading system comprises a sample reservoir for receiving a sample and a metering volume reservoir. The sample reservoir may have a relatively large volume so that it is adapted for receiving a sample. The sample may be delivered manually or automatically. The metering volume reservoir may have a volume selected based on the application for which the sample loading system is used. The metering volume reservoir may for example have a volume between 1 nl and 2000 nl, or between 1 nl and 1000 nl, or between 1 nl and 50 nl, or between 1 nl and 10 nl, although embodiments are not limited thereto.

The sample reservoir and a first side of the metering volume reservoir are interconnected through a first channel, such as a microfluidic channel, with a first flow resistance so as to allow filling of the metering volume reservoir with a metered amount of sample.

In some embodiments, the sample loading system further comprises a further reservoir for receiving a second fluid, the further reservoir being interconnected with the metering volume reservoir at the first side via a second channel having a second flow resistance being smaller than the first flow resistance. The ratio of the first flow resistance to the second flow resistance may in some examples be at least 5 to 1, or in some examples be at least 10 to 1.

A particular flow resistance of a microfluidic component can be obtained by selecting appropriate diameters of the channels forming the microfluidic component, by introducing specific features in the corresponding channels, by adjusting the walls of the channels, etc. Creating a certain flow resistance as such is known by the person skilled in the art and therefore is not discussed in more detail here.

In some embodiments, the sample loading system further comprises a first valve V1 for blocking flow of the sample from the metering volume reservoir into the second channel.

In some embodiments, the sample loading system further comprises a second valve V2 connected to the second side of the metering volume reservoir for controlling the blocking and flowing of sample from the metering volume reservoir to a further processing and/or analysis system. The volume of fluid between valves V1 and V2 defines the size of the metered volume.

In some embodiments, the sample loading system further comprises a first timing circuitry for controlling the second valve as function of the filling of the further reservoir. In some embodiments, the first timing circuitry allows opening of the second valve thereby allowing sample to flow from the metering volume reservoir to a processing and/or analysis system.

In some embodiments, systems of the disclosure allow an accurate metered amount of sample to be obtained by using a known fixed metering volume reservoir to meter the sample. In some embodiments, the sample reservoir is connected to the metering volume reservoir by a high resistance fluidic element. Valves open up a low resistance fluid path to the buffer reservoir. Once the low resistance fluid path is connected to the metered volume, minimmal excess sample is sucked into the metered volume through the high resistance fluid element.

In some embodiments, the sample loading system is implemented in a microfluidic substrate. The substrate may be made from any suitable material, such as, for example, a semiconductor substrate, glass, quartz, fused silica, polymers, metal oils, etc.

In some embodiments, sample loading systems of the disclosure allow a known volume of sample fluid to be metered or measured and dispensed using a capillary-driven system with only capillary trigger valves. Capillary trigger valves are as such well-known and therefore are not discussed in more detail here. In some embodiments, other types of valves are used, still allowing for a system where no user interaction is required. In some embodiments, the system also operates without the need for a pumping system. Thus, in some embodiments, the disclosed sample loading and/or metering system is completely passive.

By way of illustration, embodiments of the present invention not being limited thereto, further features and advantages of some embodiments will be further described with reference to FIG. 1. FIG. 1 illustrates a schematic representation of an exemplary microfluidic device according to an embodiment of the present invention. The sample loading system 100 comprises a sample reservoir 110 wherein the sample can be introduced. Introduction of the sample in the sample reservoir can be performed in a manual or automated way. The volume of the sample reservoir 110 may be large, so as to be able to receive both small and large volume samples. The sample reservoir 110 is connected to a channel C1 via a fluidic resistor element R1. Fluidic resistor elements as such are well known in microfluidic devices and are as such not further discussed in detail here. Upon introduction of a sample fluid into the sample reservoir 110, fluid flows through the fluidic resistor element R1 into channel C1 by capillary forces. The flow is stopped on one end of channel C1 by a first valve V1, in the present example being a capillary trigger valve V1. Connected to the other end of channel C1 is the metering volume reservoir 120, which can be a channel or reservoir of known volume. The metered volume fills with fluid by capillary forces until it reaches second valve V2, in the present example being a capillary trigger valve V2. The volume of fluid between valves V1 and V2 defines the size of the metered volume. At a certain moment in time, a buffer fluid is added to a buffer reservoir 130. The addition of the buffer fluid may be done manually or in an automated way. The buffer reservoir 130 is connected to a channel C2, and first and second timing circuitry. The first timing circuitry is adapted for controlling the second valve V2 as function of the filling of the buffer reservoir 130, also referred to as further reservoir 130, for allowing opening the second valve V2. This allows the metered sample to flow from the metering volume reservoir 120 to a processing and/or analysis system 200. The first timing circuitry is in the present example based on a microfluidics capillary channel, referred to as timing channel T2. The timing channel can be a single channel or a number of channels connected in series with the purpose of actuating a capillary trigger valve at a predetermined time after introduction of the buffer fluid. The second timing circuitry is adapted for controlling the third valve V3 being a valve between the buffer reservoir 130 and first valve V1, allowing for introducing a predetermined time delay between the filling of the buffer reservoir 130 and the opening of the third valve V3, whereby the predetermined time delay is selected so that it allows filling of the metering volume reservoir 120 completely with sample. In this way an accurate metered volume is obtained. The second timing circuitry is in the present example based on a microfluidics capillary channel, referred to as timing channel T1. The timing channel can be a single channel or a number of channels connected in series with the purpose of actuating a capillary trigger valve at a predetermined time after introduction of the buffer fluid. In practice, when a buffer fluid is introduced in buffer reservoir 130, channel C2 fills by capillary forces and stops at capillary trigger valve V3. The timing of T1 is designed such that trigger valve V3 is actuated after the metered volume has filled with fluid. Once third valve V3 is actuated, the buffer fluid proceeds through fluidic resistor element R2 by capillary forces until it reaches the first valve V1 where the buffer fluid meets the previously stopped sample fluid. Thus, a fluid path from the buffer reservoir to the metered volume 120 via fluidic resistor element R2 is opened. Timing channel T2 is designed such that it actuates second valve V2 after the buffer fluid arrives at first valve V1. Once second valve V2 is actuated, the flow proceeds to the rest of the system by capillary forces. During this stage, the fluid entering the metered volume is the sample fluid via R1 and the buffer fluid via R2. The resistance of R1 can be designed such that it is much larger than the resistance R2. In this case, after the second valve V2 is opened and the fluid is transported to the further analysis system 200, much more buffer fluid will enter the metered volume 120 than sample fluid. Thus, the volume of sample fluid transferred to the rest of the system will be the metered volume plus a small, possibly negligible, amount of fluid leaking from the sample reservoir via R1. This allows obtained a substantially accurate metered volume of a sample for further processing/analyzing.

Figure 2:
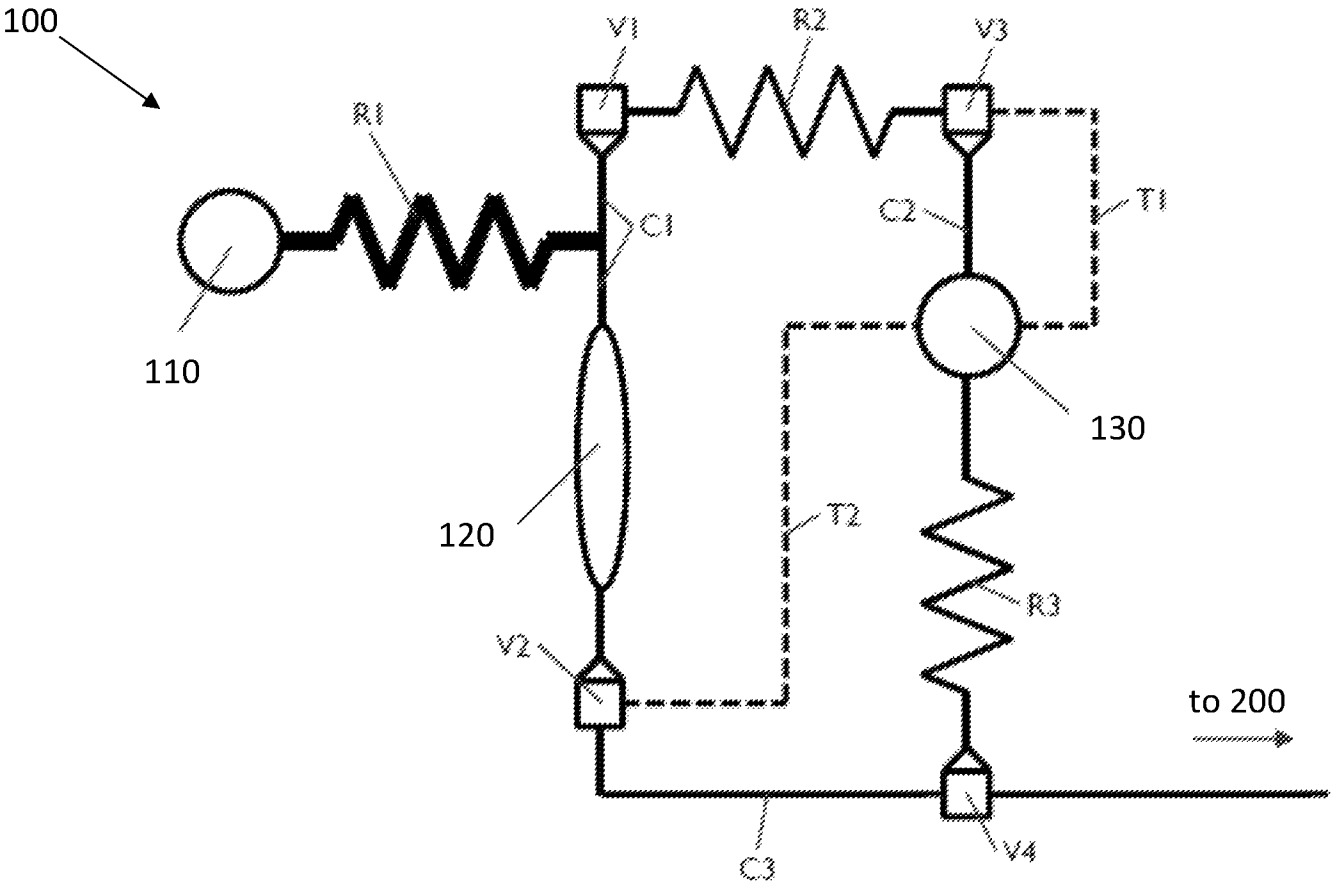
FIG. 2 shows a second exemplary sample loading system according to an example embodiment of the present invention.

In a second example, an implementation is shown for precisely metering and diluting a sample. FIG. 2. schematically shows a system for precisely metering and then diluting a sample. In this case the sample, for example a blood sample, is diluted with a dilution buffer (for example, the fluid supplied to the buffer reservoir). In addition to the channel C2, timing channel T1, and timing channel T2, the buffer reservoir is connected to a fluidic resistor element R3. Upon introducing the dilution buffer into the buffer reservoir 130, the buffer flow proceeds through the fluidic resistor element R3 until it reaches valve V4, in the present example being a capillary trigger valve V4. Valve V4 is triggered (or opened) via channel C3 once third valve V3 is triggered. The system then proceeds to mix the blood sample contained within the metered volume with the dilution buffer. The fluidic resistor element R3 is chosen so that the desired mixing ratio between the whole blood sample and dilution buffer is achieved.

The examples shown make use of capillary trigger valves. Such valves can be produced using silicon processing with two-step etch valves and hydrophobic cover (closed channels) or no cover (open channels). In some embodiments, other capillary trigger valves can be used.

Furthermore, in some embodiments, one or more of the valves may not be capillary trigger valves but rather electronic valves of which the actuation is based on electronic signals. More particularly, systems may be adapted for detecting when a fluid is added to the further reservoir 130. Timing circuitry may then be used for providing an electronic signal to the electronic valve, whereby the timing circuitry is triggered by the detection of fluid in the further reservoir 130 and whereby the timing circuitry provides a time delay for electronically opening the electronic valve. The time delay typically may be selected so as to guarantee that the metering volume reservoir 120 is first completely filled with sample. In this way, although no capillary trigger valves are used, a system is still obtained that allows for accurate metering of sample based solely on capillary forces, i.e. without needing a pumping unit.

Figure 3:
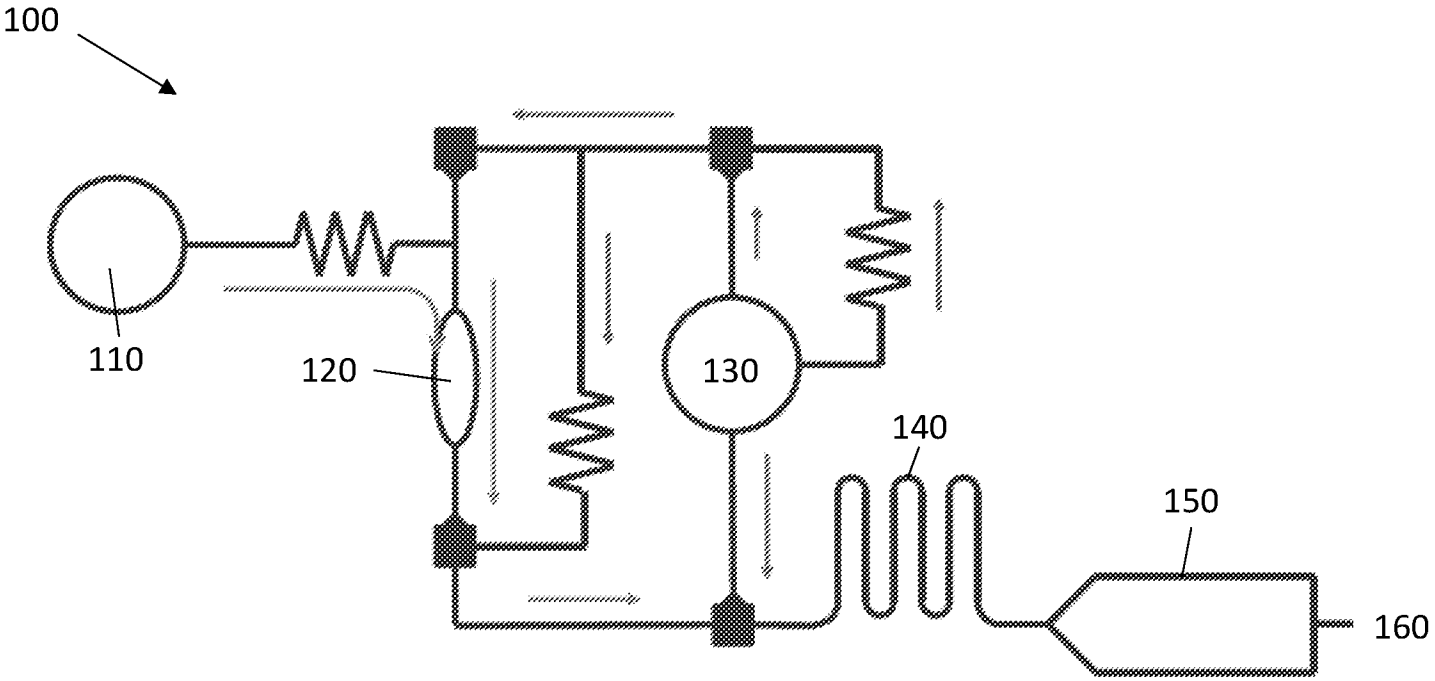
FIG. 3 illustrates a sample processing and/or analysis device comprising a sample loading system according to an example embodiment of the present invention.

In one aspect, the present invention also relates to a microfluidic sample processing and/or analysis device comprising a sample loading system as described in the first aspect. Such a device may be a diagnostic device, although embodiments are not limited thereto. The device may be for identifying an object in a sample. One example of such a system, although embodiments are not limited thereto, is a system for blood cell differentiation or blood counting. Volumetric metering can then be performed, for example, prior to performing a red and white blood cell differential analysis. A small quantity of blood is metered to get an accurate volume for the cell counting. In the case of red blood cells, the blood is then diluted prior to imaging. In the case of white blood cells, dilution is not needed but red blood cell lysis and filtration is required prior to imaging. Also for this application, it can be advantageous to have a completely passive sample loading system, using only capillary forces to meter and dispense the sample into the further processing/analyzing component, such as for example a detection chamber for imaging. By way of illustration, embodiments of the present invention not being limited thereto, an exemplary system is shown in FIG. 3, whereby a sample loading system 100 is used corresponding to the exemplary sample loading system 100 as shown in FIG. 2. The system furthermore comprises a further channel 140, a detection chamber 150, and a sample outlet 160. The direction of the flow of the different fluids is indicated by arrows in FIG. 3.

In some embodiments, channel 140 is a mixing channel with dimensions and geometry conducive to microfluidic mixing. Many designs for such a channel exist in the art and this will therefore not be detailed here. In some embodiments, sample outlet 160 is a vent to allow air to escape but not liquid so when the liquid arrives to the vent, the flow stops. Alternatively, in some embodiments, sample outlet 160 is a connection to a capillary pump, which has a volume and capillary pressure conducive to maintaining a flow over a period of time with capillary forces alone. The capillary pump can be external to the sample loading system 100 described herein, that is, it is fabricated separately and interfaced with the substrate containing the sample loading system 100.

In another aspect, the disclosure provides methods for loading a sample into a microfluidic system. Such a method may be performed if, for example, an accurate metered volume of a sample is required, e.g. for further processing or analyzing. In some embodiments, the method comprises introducing a sample into a sample reservoir thereby allowing the sample fluid to fill a metering volume reservoir through a first channel having a first flow resistance and stopping the sample flow with a first and second valve once the metering volume reservoir is filled. In some embodiments, the method further comprises introducing a second fluid into a further reservoir thereby opening a second channel having a second flow resistance being smaller than the first flow resistance, the second channel being between the further reservoir and the metering volume reservoir for allowing the sample and the second fluid to come in contact. The introduction of the second fluid into the further reservoir further results in opening the second valve allowing the sample to further flow to a further processing and/or analysis system based on timing circuitry. In some embodiments, the method further comprises timing the opening of the second valve to allow the sample to flow to a further processing and/or analysis system. In some embodiments, the second valve is a capillary valve and timing the opening of the second valve comprises allowing a flow from the further reservoir to the second valve via a channel with a predetermined length, so as to introduce a predetermined time delay between the filling of the further reservoir and the opening of the second valve. In some embodiments, timing the opening of the second valve comprises electronically timing the second valve as function of the filling of the further reservoir. In some embodiments, the sample is diluted by mixing the sample with the second fluid, which may be a diluting buffer fluid.

Other method steps may correspond with the functionality of the different features and advantages described for the first aspect.

In another aspect, the disclosure provides use of a sample loading system for applying identification of an object in a sample, such as, for example, blood cell differentiation or blood counting.

While some embodiments have been illustrated and described in detail in the appended drawings and the foregoing description, such illustration and description are to be considered illustrative and not restrictive. Other variations to the disclosed embodiments can be understood and effected in practicing the claims, from a study of the drawings, the disclosure, and the appended claims. The mere fact that certain measures or features are recited in mutually different dependent claims does not indicate that a combination of these measures or features cannot be used. Any reference signs in the claims should not be construed as limiting the scope.

What is claimed is:

1. A sample loading system for loading a sample into a processing and/or analysis system, the sample loading system comprising:

a sample reservoir for receiving a sample and a metering volume reservoir, the sample reservoir and a first side of the metering volume reservoir being interconnected through a first channel with a first flow resistance so as to allow filling of the metering volume reservoir with a metered amount of sample, a further reservoir for receiving a second fluid, the further reservoir being interconnected with the metering volume reservoir at the first side via a second channel having a second flow resistance being smaller than the first flow resistance, a first valve for blocking flow of the sample from the metering volume reservoir into the second channel, a second valve connected to a second side of the metering volume reservoir for controlling the blocking and flowing of sample from the metering volume reservoir through a third channel, and a first timing circuitry for controlling the second valve as function of the filling of the further reservoir, wherein the first timing circuitry allows opening of the second valve and allows sample to flow from the metering volume reservoir through the third channel to a processing and/or analysis system.

2. The sample loading system of claim 1, wherein the ratio of the first flow resistance and the second flow resistance is at least 5 to 1, or at least 10 to 1.

3. The sample loading system of claim 1, wherein a third valve is present between the further reservoir and at least part of the second channel, the third valve being controlled by a second timing circuitry for introducing a predetermined time delay between the filling of the further reservoir and the opening of the third valve, wherein opening of the third valve allows complete filling of the metering volume reservoir with sample.

4. The sample loading system of claim 1, wherein the second valve is a capillary valve and wherein the first timing circuitry is a microfluidic connection between the further reservoir and the second valve, and wherein the first timing circuitry comprises a first timing channel having a length adapted for introducing a predetermined time delay between the filling of the further reservoir and the opening of the second valve.

5. The sample loading system of claim 3, wherein the third valve is a capillary valve and wherein the second timing circuitry is a microfluidic connection between the further reservoir and the third valve, wherein the second timing circuitry comprises a second timing channel having a length adapted for introducing a predetermined time delay between the filling of the further reservoir and the opening of the third valve, and wherein the opening of the third valve allows the metering volume reservoir to fill completely with sample.

6. The sample loading system of claim 3, wherein the first or the second timing circuitry is an electronic timing circuitry for electronically controlling the second valve or third valve, respectively.

7. The sample loading system of claim 1, wherein the further reservoir further comprises an interconnection to the third channel to a processing and/or analysis system, wherein the interconnection allows mixing of the sample with a buffer fluid added to the further reservoir.

8. The sample loading system of claim 1, which is a microfluidic or nanofluidic system.

9. The sample loading system of claim 8, wherein the microfluidic or nanofluidic system is (a) an open channel system or (b) a closed channel system, the upper side of the closed channel system being closed with a hydrophobic cover plate.

10. A microfluidic sample processing and/or analysis device comprising the sample loading system of claim 1.

11. The microfluidic sample processing and/or analysis device of claim 10, which is a diagnostic device.

* * * * *